United States Patent [19]

Polonsky

[11] Patent Number: 4,777,850

[45] Date of Patent: Oct. 18, 1988

[54] DRILL-OUT THREADED BROKEN BOLT EXTRACTOR

[75] Inventor: Eli Polonsky, Aurora, Colo.

[73] Assignee: Drill-Out, Inc., Denver, Colo.

[21] Appl. No.: 104,656

[22] Filed: Oct. 5, 1987

Related U.S. Application Data

[63] Continuation-in-part of Ser. No. 861,342, May 9, 1986, abandoned.

[51] Int. Cl.[4] ..... B25B 13/48

[52] U.S. Cl. ..... 81/53.2; 81/441

[58] Field of Search ..... 81/53.2, 441; 7/158; 408/22, 67, 118, 230; 29/213 E

[56] References Cited

U.S. PATENT DOCUMENTS

| | | | |
|---|---|---|---|
| 2,684,606 | 7/1954 | Brawley | 81/53.2 |
| 4,078,458 | 3/1978 | Berendzen | 81/53.2 X |
| 4,604,917 | 8/1986 | Polonsky | 81/53.2 |

*Primary Examiner*—Debra Meislin

*Attorney, Agent, or Firm*—N. J. Aquilino

[57] ABSTRACT

A drill-out threaded broken bolt fastener extractor combination tool wherein an extractor is combined with a drill head so that in use the drilling and extracting steps are performed in the same operation. The extractor is reciprocally and rotatably mounted on the drill bit shaft enabling the drill bit to penetrate within a broken bolt stud and subsequently having the extractor engage the same for removal. A drive head is provided for a suitable force-producing device.

21 Claims, 2 Drawing Sheets

DRILL-OUT THREADED BROKEN BOLT EXTRACTOR

RELATED APPLICATIONS

The present application is a continuation-in-part of U.S. Ser. No. 06/861,342, filed May 9, 1986, now abandoned.

BACKGROUND AND SUMMARY OF THE INVENTION

The present invention relates to extractors for removing broken threaded fasteners such as bolt studs from broken bolts, and more particularly to a broken fastener extractor combined with a drill head in a single combination tool.

The present invention is an improvement over my prior U.S. patent entitled "Easy-Out Threaded Fastener" filed Mar. 12, 1985 now U.S. Pat. No. 4,604,917.

Conventional easy out type bolt extractors for extracting broken bolt studs within a threaded bore are formed with gripping teeth and/or shaped flutes adapted to engage the sides of a previously drilled bore through the broken bolt stud. The gripping surfaces remove the threaded bolt stud when the extractor is rotated in a direction opposite to that of the bolt threads. These extractors require that first a hole be drilled through the broken bolt stud prior to the insertion of the extractor. A shortcoming of this tool is that the drill bit is often broken in the process of drilling which results in a compound problem of removal of both the broken bolt stud and the broken drill bit. Even when the drill bit is not broken, the bolt stud is often driven deeper into the threaded hole making extraction more difficult. This process requires that the drill bit be removed before inserting the bolt extractor so that at least three separate operations are needed using at least three separate tools including a drill bit, a tap wrench and extractor.

The present invention combines a drill for forming a bore within a broken bolt stud and bolt stud extractor for removing the broken bolt stud in a single tool. The lower portion of the tool is provided with a drill bit having a cutting edge threaded with a pitch in the direction opposite to the threads of the broken bolt stud being extracted and a drill body having a truncated surface which tapers outwardly toward the drill bit. The drill body is connected to a threaded shaft, the upper portion of which includes a drive head for a suitable hand or power driven tool. A bolt extractor collet is threadedly mounted on the drill bit shaft between the drill bit and the drive head portion of the tool.

To remove a broken bolt stud which remains within a threaded bore, the drill bit engages the broken bolt stud and driving of the drive head drills a hole within the body of the broken bolt stud. As the tool penetrates within the broken bolt stud, the extractor collet, which is threadedly mounted on the drill bit shaft, engages the interior of the hole being bored in the broken bolt stud. At that point, the drilling mode stops and the drill bit is rotated out of the bore toward the extractor collet by the reverse threads on the drill bit shaft. As the drill bit shaft and drill bit are driven outwardly from the bore, the interior surface of the extractor collet engages the truncated surface on the drill body causing a lower resilient portion of the extractor collet to expand out-within the broken bolt stud. Because the extractor and the drill bit have been rotated together, they act as a single unit, and therefore, continued rotation of the tool will unthread the broken bolt stud to extract it.

Among the objects of the present invention are the provision of a threaded fastener extractor tool which is combined with a drilling bit so that a broken bolt stud may be removed in a single operation.

DESCRIPTION OF PREFERRED EMBODIMENTS

Reference will now be made in detail to the present preferred embodiments of the invention, examples of which are illustrated in the accompanying drawings. Wherever possible, the same reference numbers will be used throughout the drawings to refer to the same or like parts.

Figure 1:
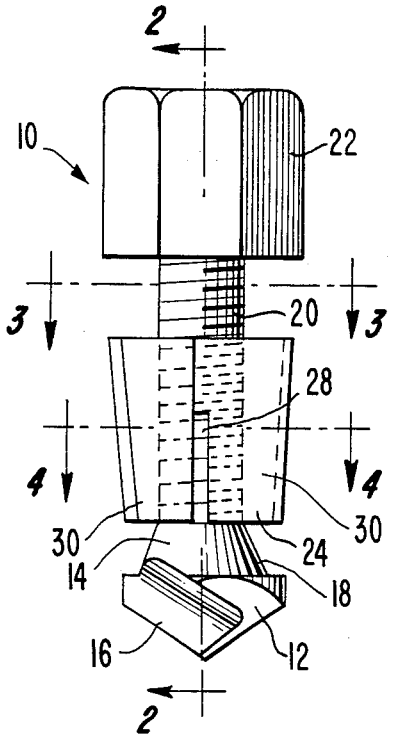
FIG. 1 is an elevational view of a first embodiment of the bolt extractor combination tool of the present invention.
Figure 4:
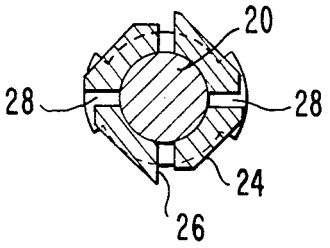
FIG. 4 is a sectional view taken along the lines 4—4 of FIG. 1.
Figure 3:
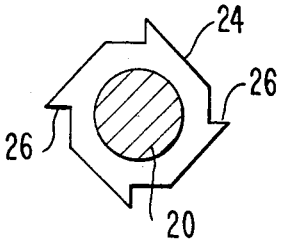
FIG. 3 is a sectional view taken along the lines 3—3 of FIG. 1.
Figure 2:
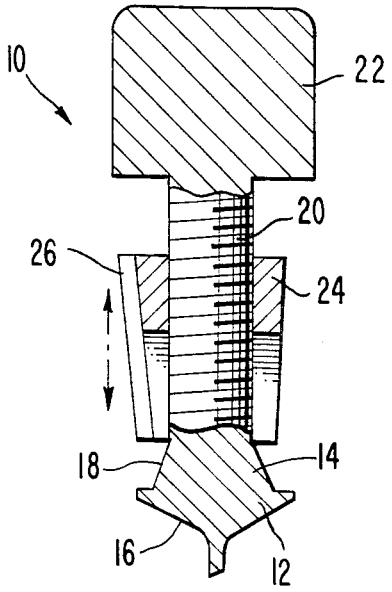
FIG. 2 is a sectional view taken along the lines 2—2 of FIG. 1.

FIGS. 1 to 4 illustrate the easy-out type of bolt extractor 10 of the present invention. The lower portion of the bolt extractor 10 includes a drill bit 12 which is used to drill a bore within a broken bolt stud to be extracted. The drill bit 12 includes a drill body 14 and cutting edges 16. The drill body 14 is formed with a truncated outer surface 18. Assuming most broken bolts which are to be removed have right-handed threads, cutting edges 16 of the drill bit 12 are provided with a left-handed or counterclockwise cutting pitch. The drill body 14 is integrally connected to a tool shaft 20 which is threaded with right-handed or clockwise threads in a pitch opposite to that of the cutting edges 16 of the drill bit 12. The truncated surface 18 of the drill body is tapered outwardly from the point where the drill body 14 attaches to the threaded tool shaft 20 toward the cutting edges 16.

The upper end of the tool shaft 20 is formed with an integral drive head 22 adapted to be driven by a suitable driving means such as a power tool chuck or hand-driven wrench.

The extractor tool 10 includes an extractor collet 24 having an internally threaded bore which acts as a connecting means between the collet 24 and the threaded tool shaft 20. The collet 24 has a tapered exterior with fluted teeth 26 adapted to grip an interior bore surface formed by the drill bit 12 as described hereinbelow. The extractor collet 24 is formed with a series of longitudinal slots 28 which separate the extractor collet 24 into a series of segments 30, each segment 30 having one of the fluted teeth 26. The slots 28 provide resiliency to the lower end of the segments 30. The extractor collet 24 is reciprocally and rotatably moveable along the longitudinal axis of the threaded tool shaft 20 by the relative movement of the interior threads of the extractor collet 24 and the threads on the tool shaft 20.

A stud remaining in a threaded bore when a bolt is broken is extracted by the easy-out broken bolt extractor tool 10 of the present invention by drilling a bore within the broken bolt stud using a suitable driving tool rotated in a left-handed or counterclockwise direction to drive the drill bit 12 of the extractor tool 10. As the drill bit 12 penetrates the broken bolt stud, the tapered fluted teeth 26 of the extractor collet 24 engage the interior wall of the bore being drilled within the broken bolt stud. Once the collet 24 is engaged in the broken bolt stud, continued rotation of the extractor tool 10 by the drive means causes the drilling mode to stop. The drill bit 12 is rotated out of the bore in the broken bolt stud because of the reverse threaded connection between the collet 24 and the threaded shaft 20, causing the drill bit 12 to move toward the extractor collet 24. The drill bit 12 and the extractor collet 24 become engaged and the resilient segments 30 of the extractor collet 24 are expanded outwardly by the camming action of the truncated surface 18 against the interior surfaces of the segments 30. The outward expansion of the collet segments 30 causes the fluted teeth 26 to securely grip the interior of the bore. Thus joined, the extractor collet 20 and the driven tool shaft 20 and drill bit 12 act as a single unit and continuous driving of the tool 10 in the counterclockwise direction provides an extracting force to unthread the broken bolt stud.

Figure 5:
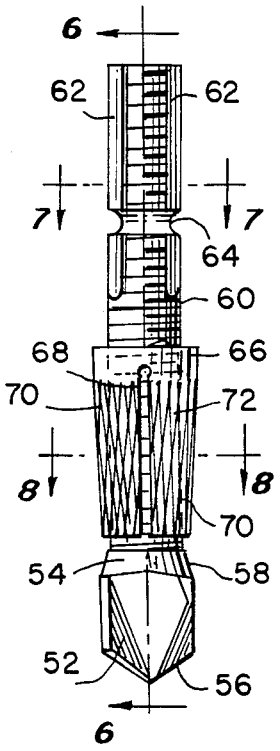
FIG. 5 is an elevational view of a second embodiment of the bolt extractor combination tool of the present invention.
Figure 8:
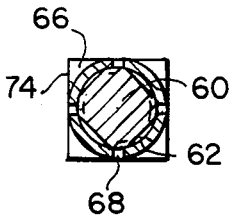
FIG. 8 is a sectional view taken along lines 8—8 of FIG. 5.
Figure 6:
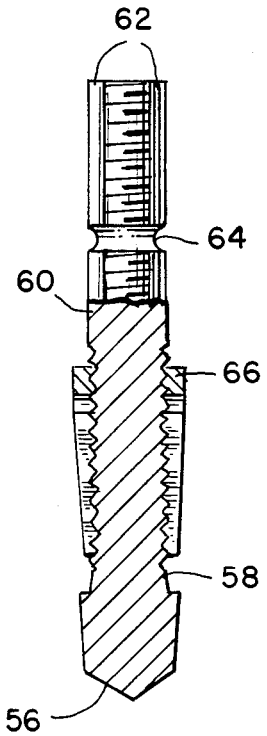
FIG. 6 is a partial sectional view taken along the line 6—6 of FIG. 5.
Figure 7:
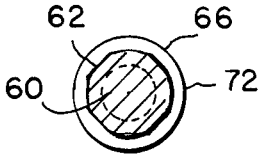
FIG. 7 is a sectional view taken along the lines 7—7 of FIG. 5.

A second embodiment of the present invention is shown in FIGS. 5 through 8. In this embodiment, an easy-out type broken bolt extractor tool 50 is formed with a drill bit 52 on its lower end including a drill body 54 and left-handed cutting edges 56. The drill body 54 has a truncated surface 58 which tapers outwardly toward the drill bit 52. The drill body 54 is connected to a tool shaft 60 threaded with right-handed or clockwise threads.

The upper end of the tool shaft 60 is formed with flat sides 62 which are adapted to connect the tool 50 to a suitable driving means such as a power tool chuck or hand-driven wrench. In this embodiment, the need for a separate integral drive head, as shown in the first embodiment, is eliminated. The tool shaft 60 also includes a weakened portion in the form of an annular groove 64. If the extractor tool 50 is jammed during removal of a broken bolt stud, the tool shaft 60 will shear along the annular groove 64 thereby leaving a portion on the tool shaft so that the extractor tool 50 can be gripped and removed.

An extractor collet 66 is threadably mounted on the threaded tool shaft 60 using an internally threaded bore. The extractor collet 66 is formed with a tapered exterior and includes longitudinal slots 68 which separate the extractor collet 66 into a series of segments 70. The tapered exterior of the extractor collet 66 is formed with a knurled gripping surface 72 for gripping the interior walls of a bore formed by the drill bit 52. The slots 68 provide resiliency to the segments 70 particularly near the lower end of the extractor collet 66. The upper part of the extractor collet includes flat surfaces 74 to accommodate a tool to loosen it should it become jammed in the drilled bore.

The extractor collet 66 is reciprocally and rotatably moveable along the longitudinal axis of the threaded tool shaft 60 toward and away from the drill bit 52.

The operation of the second embodiment of the bolt extractor tool 50 of the present invention is essentially the same as described hereinabove with respect to the extractor tool shown in the embodiments of FIGS. 1 to 4. The drill bit 52 is driven by a suitable power source to form a bore within the broken bolt stud. When the extractor collet 66 engages the wall of the bore, the knurled gripping surface 72 causes the tool shaft 60 and drill bit 52 to rotate out of the bore toward the collet 66 by the action of the connecting threads between the threaded shaft 60 and the collet 66. As the lower segments 70 of the extractor collet 66 contact the truncated surface 58 on the drill body 54, they are expanded outwardly and grip the interior bore being formed in the broken bolt stud. Continued rotation of the extractor tool 50 in a counterclockwise direction causes the broken bolt stud to be extracted.

It will be appreciated that various changes and modifications may be made to the above-described invention within the scope of the appended claims.

I claim:

1. A tool assembly for extracting a broken threaded fastener threaded in a first direction of tightening in a bore, said assembly comprising:

drill means for forming a bore in the broken fastener upon rotation in the opposite direction to the first direction of tightening the fastener, shaft means extending from said drill means for rotating said drill means, means to accommodate a drive tool on the opposite end of said shaft means for rotating said shaft means and said drill means, extractor means disposed on said shaft means, said assembly characterized by expander means cooperating with said extractor means for enabling said extractor means to grip the interior of the bore made by said drill means in the broken fastener to prevent relative rotation in said opposite direction; and connector means interconnecting said shaft means and said extractor means for moving said extractor means on said shaft means in reponse to rotation of said shaft means by said drive means in said opposite direction toward said drill means to a stop position on said expander means, preventing further rotation of said extractor means on said shaft means and for expanding said extractor means by said expander means whereby said extractor means grips the interior of the bore in the fastener to remove the fastener by continued rotation of said drive means.

2. The tool assembly as set forth in claim 1 further characterized by said connector means including coacting threads between said extractor means and said shaft means, said threads having a lead direction for moving said extractor means toward said drill means as said drill means is rotated in the bore drilling direction.

3. An assembly as set forth in claim 1 further characterized by said expander means including a truncated surface tapered outwardly in the direction toward said drill means for engaging and limiting movement of said extractor means relative to said drill means.

4. An assembly as set forth in claim 3 further characterized by said expander means being located on said shaft means adjacent the upper portion of said drill means.

5. An assembly as set forth in claim 1 further characterized by said extractor means having a downwardly and inwardly tapered exterior; and said extractor means having gripping means on said exterior for gripping the interior of the bore made by said drill means.

6. An assembly as set forth in claim 5 further characterized by said gripping means including a plurality of teeth extending from the exterior of said extractor means.

7. An assembly as set forth in claim 5 further characterized by said gripping means including a knurled surface on the exterior of said extractor means.

8. An assembly as set forth in claim 1 wherein said means to accommodate a drive tool on said shaft means includes an integrally attached drive head having flat surfaces adapted to accommodate a drive tool.

9. An assembly as set forth in claim 1 wherein said means to accommodate a drive tool on said shaft means includes a series of flat surfaces formed on said shaft means.

10. An assembly as set forth in claim 5 further characterized by said extractor means including circumferentially spaced slots extending in a longitudinal direction on the lower portion of said extractor means forming a series of segments, said segments being resilient and adapted to be expanded by said expander means to annularly contact the interior of the bore formed by said drill means.

11. An assembly as set forth in claim 10 further characterized by said extractor means including an upper portion in threaded engagement with said threaded shaft means and a skirt portion depending therefrom, said skirt portion including the spaced segments on said extractor means.

12. An assembly as set forth in claim 1 further including a weakened portion on said shaft means permitting shearing of said shaft at said weakened portion upon application of excessive force from the drive tool.

13. An assembly as set forth in claim 10 wherein said expander means is located between said drill means and said shaft means and is further characterized by a truncated expansion surface tapered in a direction from said shaft means outwardly toward said drill means.

14. A tool assembly for extracting a broken threaded fastener threaded in a first direction of tightening in a bore, said assembly comprising:

drill means for forming a bore in the broken fastener upon rotation in the opposite direction to the first direction of tightening the fastener, shaft means extending from said drill means for rotating said drill means, means to accommodate a drive tool on the opposite end of said shaft means for rotating said shaft means and said drill means, extractor means rotatably and longitudinally moveably disposed on said shaft means, said extractor means having a gripping means thereon, said assembly characterized by expander means on said shaft means cooperating with said extractor means for enabling said extractor means to grip the interior of the bore made by said drill means in the broken fastener to prevent relative rotation in said opposite direction; and threaded connector means interconnecting said shaft means and said extractor means for moving said extractor means on said shaft means in reponse to rotation of said shaft means by said drive means in said opposite direction toward said drill means to a stop position on said expander means, preventing further rotation of said extractor means on said shaft means and for expanding said extractor means by said expander means whereby said extractor means grips the interior of the bore in the fastener to remove the fastener by continued rotation of said drive means.

15. The tool assembly as set forth in claim 14 further characterized by said threaded connector means including coacting threads on said extractor means and said shaft means, said threads having a lead direction for moving said extractor means toward said drill means as said drill means is rotated in the bore drilling direction.

16. An assembly as set forth in claim 14 further characterized by said expander means including a truncated surface tapered outwardly in the direction toward said drill means for engaging and limiting movement of said extractor means relative to said drill means.

17. An assembly as set forth in claim 1 further characterized by said extractor means having a downwardly and inwardly tapered exterior; said gripping means being located on said tapered exterior for gripping the interior of the bore made by said drill means.

18. An assembly as set forth in claim 17 further characterized by said gripping means including a knurled surface on the exterior of said extractor means.

19. An assembly as set forth in claim 14 wherein said means to accommodate a drive tool on said shaft means includes a series of flat surfaces formed on the upper portion of said shaft means.

20. An assembly as set forth in claim 17 further characterized by said extractor means including circumferentially spaced slots extending in a longitudinal direction on the lower portion of said extractor means forming a series of segments, said segments being resilient and adapted to be expanded by said expander means to annularly contact the interior of the bore formed by said drill means.

21. An assembly as set forth in claim 14 further including a weakened portion on said shaft means permitting shearing of said shaft at said weakened portion upon application of excessive force from the drive tool.

* * * * *

UNITED STATES PATENT AND TRADEMARK OFFICE

CERTIFICATE OF CORRECTION

PATENT NO. : 4,777,850

DATED : October 18, 1988

INVENTOR(S) : ELI POLONSKY

It is certified that error appears in the above-identified patent and that said Letters Patent is hereby corrected as shown below:

Column 4, Claim 1, line 44, change the word "means", second occurrence, to --tool--

Column 4, Claim 1, line 51, change the word "means" to --tool--.

Column 6, Claim 14, line 10, change the word "means" to --tool--.

Column 6, Claim 14, line 17, change the word "means" to --tool--.

Signed and Sealed this

Seventh Day of August, 1990

*Attest:*

HARRY F. MANBECK, JR.

*Attesting Officer*

*Commissioner of Patents and Trademarks*